United States Patent [19]

Terrell et al.

[11] Patent Number: 4,613,394

[45] Date of Patent: Sep. 23, 1986

[54] STAGED CHEMICAL PIPE CUTTER

[75] Inventors: Jamie B. Terrell, Fort Worth, Tex.; Benny J. Holmes, Broussard, La.

[73] Assignee: Gearhart Industries, Inc., Fort Worth, Tex.

[21] Appl. No.: 589,561

[22] Filed: Mar. 14, 1984

Related U.S. Application Data

[63] Continuation of Ser. No. 183,178, Sep. 2, 1980, abandoned.

[51] Int. Cl.[4] ..... E21B 29/00

[52] U.S. Cl. ..... 156/345; 156/664; 166/55.2; 166/63; 166/297

[58] Field of Search ..... 156/654, 664, 345; 166/55.2, 63, 297; 220/257, 258

[56] References Cited

U.S. PATENT DOCUMENTS

| | | | |
|---|---|---|---|
| 2,822,964 | 2/1958 | Shore | 220/258 |
| 2,987,175 | 6/1961 | Bottum | 220/257 |
| 3,076,507 | 2/1963 | Sweetman | 166/55.2 |
| 3,204,805 | 9/1965 | May | 220/258 |

*Primary Examiner*—Jerome Massie

*Attorney, Agent, or Firm*—Hubbard, Thurman, Turner & Tucker

[57] ABSTRACT

Discloses an improved tool and method for cutting material by expelling a jet stream of liquid chemical reactant into forceful flowing connection and chemical reaction with a designated area of the material. Applies a force to at least one mass of reactant to move the mass through at least one jet orifice into flowing connection with material to be cut. Improvement is provision of a double rupture membrane adapted to confine the reactant mass until force is applied.

3 Claims, 2 Drawing Figures

STAGED CHEMICAL PIPE CUTTER

This is a continuation of application Ser. No. 183,178, filed Sept. 2, 1980, now abandoned.

BACKGROUND OF THE INVENTION

This invention generally pertains to methods and apparatus for cutting or perforating conduit in a well bore and more particularly for cutting into well bore conduit with chemical reaction from fluid jets of a tool suspended from a wireline.

DISCUSSION OF THE PRIOR ART

This invention is an improvement to the invention disclosed and claimed in copending and commonly assigned U.S. application Ser. No. 155,543, filed June 2, 1980.

Whenever stuck drill pipe has to be cut to be freed or tubing is cut to be recovered, experience has shown that the cut produced by the chemical cutter offers the least trouble, smallest overall expense and the highest success in the recovery operation. This is because the cut is not flared, has no burrs, and the inside and outside diameters around the cut are not changed. The overshot used in recovery operations can be easily placed over the cut string without milling.

Additionally, the chemical cutter leaves no debris in the well. The halogen fluoride reactant used in the cutter produces a chemical reaction that dissolves the pipe in the cut area. Since no part of the cutter is expendable, there is no debris.

As noted in the referenced prior art, extremely active chemical reactants such as the powerful $HF_3$, for example, are used to cut or perforate through the walls of well conduit. Other very active reactants are Fluorine, $ClF_3$, $BrF_3$, and similar fluorine compositions.

In the cutting process the reactant or reagent is passed through a heating "pre-ignition" medium which serves to preheat the reactant, extremely active initially, into its most active reactive state, the state of being essentially an "incendiary" cutting agent which is the important chemical reaction to sever the tubing.

Then, the heated incendiary fluid is forced under high pressure through a jet orifice into flowing contact or connection with the conduit or similar object of reactable material to be cut, iron or steel for example.

OBJECTS OF THE INVENTION

The principal object of the invention is to provide a fluid jet type chemical cutting or perforating tool which will project or propell a liquid chemical reaction agent from a fluid jet wherein the liquid within the tool flows with less turbulance and also is initially confined within the tool with a greater degree of safety.

SUMMARY OF THE INVENTION

In summary, an improved apparatus is disclosed for cutting material by expelling a jet stream of liquid chemical reactant into forceful flowing connection with a designated area of said material which is provided with double, spaced apart rupture membranes provided at both ends of each chemical reactant confining chamber.

DESCRIPTION OF THE PREFERRED EMBODIMENT

Figure 1:
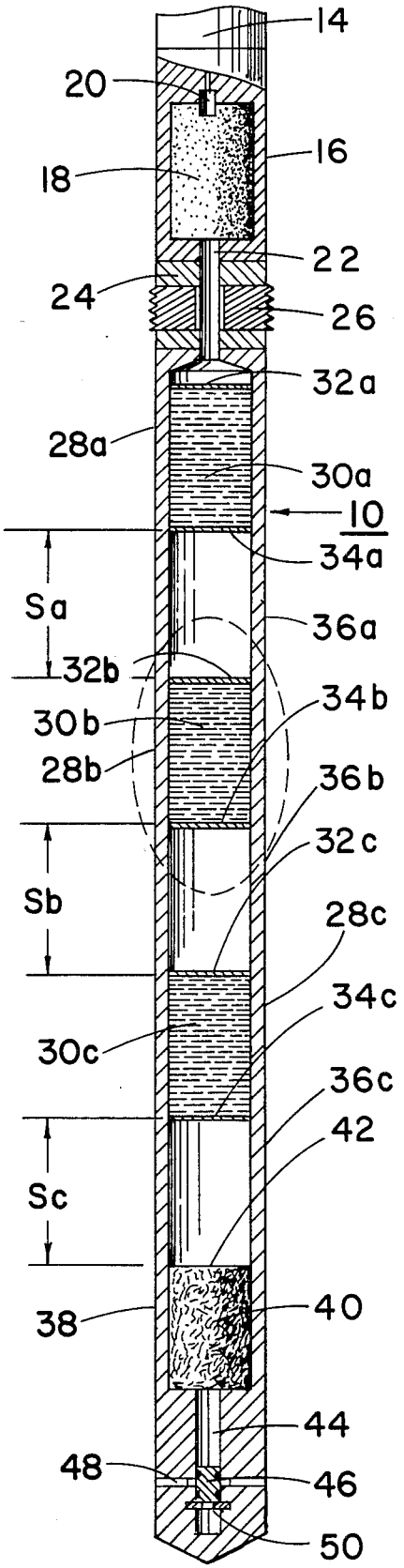
FIG. 1 is an elevational sectional view showing a chemical cutting tool of the present invention with a propellant assembly at its top in communication with a lower pipe anchor assembly and in further communication a body containing a plurality of stages of chemical reactant masses and a reactant treating composition disposed above cutting jets.

The tool 10 as shown in FIG. 1 is suspended from a cable (not shown) in a well tubing (not shown) of internal diameter slightly larger in the outside diameter of tool 10. Beginning at the top of tool 10, there is provided a section 14 which may house a casing collar locator and also the testing and firing circuits (not shown) for the ignitor 20 as later described.

Below the housing 14 is connected a power section 16 containing a propellant 18 adapted for ignition by an electrical ignitor 20.

A passage 22 extends downwardly from the power section 16 into an anchor assembly 24 in which are mounted a plurality of internal gripping slips 26 adapted to be extended by fluid pressure to engage a conduit for anchoring tool 10 in the conduit and then returned by springs (not shown), for example.

Connected below the anchor assembly 24 are a series of chambers in communication with passage 22 with the first being a first stage chemical reactant chamber **28*a* containing a reactant 30*a* housed within the chamber 28 by upper and lower rupture diaphragm 32*a* and 34*a***.

Mounted below the reactant chamber **28*a* is a second stage reactant chamber 28*b* containing a reactant 30*b* confined by upper and lower rupture diaphragm 32*b* and 32*b*** respectively.

Positioned between the chambers **28*a* and 28*b* is an air chamber section 36*a* of linear or longitudinal dimension providing a spacing Sa between the lower diaphragm 34*a* of container 28*a* and diaphragam 32*b* of container 28*b***.

Below the chemical reactant chamber **28*b* may be a third stage reactant chamber 28*c* containing a chemical reactant 30*c* confined by rupture diaphragm 32*c* and 34*c***.

Disposed between the chambers **28*b* and 28*c* may be another air chamber 36*b* providing a distance of Sb between the lower diaphragm 34*b* of chamber 28*c* and diaphragm 32*c* of chamber 28*c***.

Though not shown, additional stages of reactant chambers 28 and corresponding air chambers 36 may be provided as desirable.

Below the chamber **28*c* is a reactant heating chamber 38 containing a treating material 40** which will serve to react with the cutting reactant and heat the cutting reactant to a designated elevated temperature, giving the reactant extremely high chemical activity.

Disposed between the heating chamber 38 and the reactant chamber **28*c* may be another air chamber 36*c* providing a distance Sc between the lower diaphragm 34*c* of reaction chamber 28*c* and an upper face 42 of the treating material 40**.

In the embodiment shown, the distances Sa, Sb, and Sc are substantially equal. Other spacing may be provided, however.

A passage 44 opens out below the chamber 38. Mounted in slidable relation within passage 44 is a jet release plug 46 which, when in its upper position, covers a plurality of cutting jets 48 in sealed relation. The jet release plug 46 is releasably supported in its upper position by a shear washer 50 mounted in the passage 44 below the plug 46.

A designated force imposed from above plug 46 will cause the shear washer 50 to shear and allow the plug 46 to be moved down in the passage 44 and thereby uncover the cutting jets 48 to permit fluid flow through jets 48 into flowing connection with the inner wall of pipe (not shown), for example.

It is to be noted, that in the embodiment shown, the diaphragm 34*c* may be provided immediately disposed at or near the upper face 42 of the treating material 40 with the chamber 36*c* substantially eliminated, and also come within the spirit of the present invention.

The chemical reactant preferred for the chemical cutter of the present invention is bromine trifluoride ($BrF_3$). It is a heavy, low viscosity, amber-colored transparent fluid at all normal above-ground temperatures. It will very quickly react with water, oil, and most finely divided materials with a star-like flame. It will not detonate or explode due to shock or temperature.

In a tool of this kind, the driving force for driving the reactant 30 throggh the jetting nozzles 48 is the confined burning of a relatively slow burning propellant of the general kind used in rifles such as military artillary.

The treating material 40 may be a commercial grade steel wool or oil coated fiberglass wool, as examples. An immediate and extremely rapid reaction is caused between the incendiary reactant and the object being cut, steel in the case of a well conduit.

Figure 2:
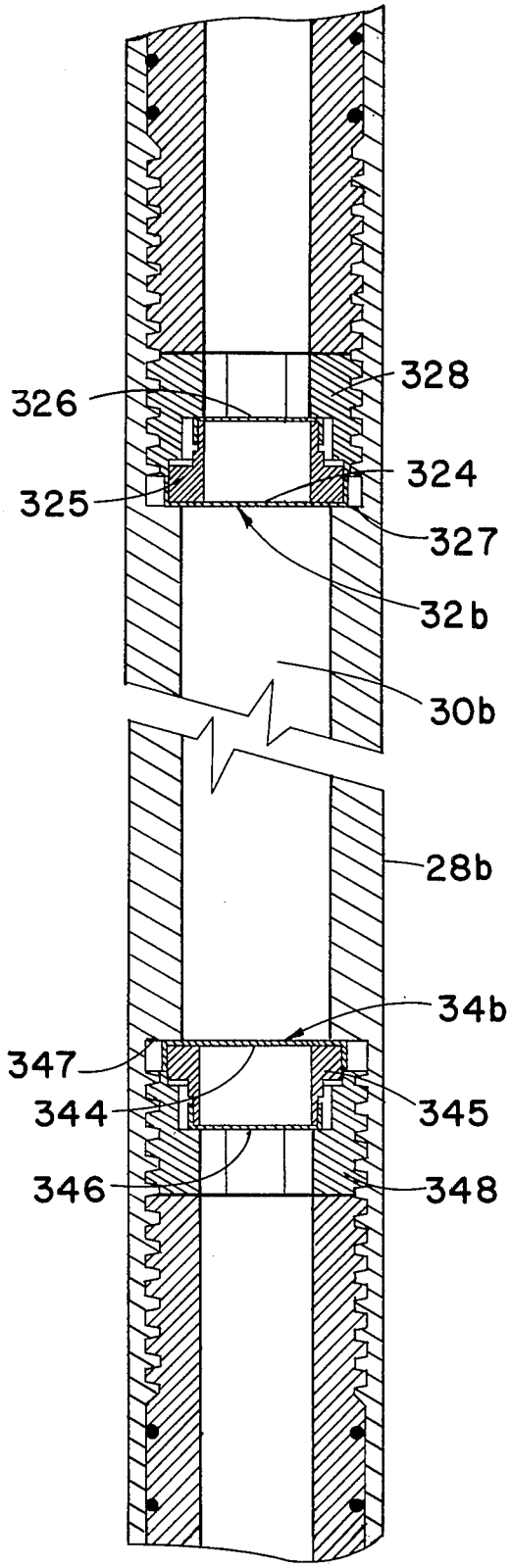
FIG. 2 is an elevational sectional view showing one of the chemical reactant chambers of the cutting tool of FIG. 1.

FIG. 2 is a detailed view of the portion of tool 28 as enclosed by the dashed line in FIG. 1 and showing the arrangement and construction of the reactant chamber 28*b*. The reactant chambers 28*a* and 28*c* are the same as chamber 28*b* as shown.

As shown, the chamber 28*b* has threaded into its ends an assembly of the diaphragm 32*b* at its top and an assembly of the diaphragm 34*b* at its bottom.

As shown, the bottom diaphram 34*b* is comprised of a rupture membrane 344 mounted in spaced apart relation by a spacer member 345 from a second rupture member 346. The peripheral edge of membrane 344 is clamped against a lower shoulder 347 defined in the body of chamber 28*b* in fluid sealed relation by a threaded retainer bushing 348. The bushing 348 bears against the peripheral surface of the membrane 346 to exert the clamping force through the spacer 345 to membrane 346.

Membranes 344 and 346 are spaced apart such that an intervening air space is provided.

The arrangement is such that fluid pressure exerted against either membrane 344 or membrane 346 will first rupture that respective membrane with such pressure subsequently being exerted against and rupturing the other membrane.

Also seen in FIG. 2 is the top diaphragm 32*b* comprising a rupture membrane 324, membrane 326, spacer member 325, shoulder 327 and retainer bushing 328, all of which are of like construction and arrangement as the elements of diaphragm 34*b*.

OPERATION OF THE PREFERRED EMBODIMENT

In operation, the tool 10 is lowered down through a string of well tubing and positioned by a means of a depth indicator and a casing collar located within section 14 (not shown) to the level at which the tubing is to be cut off so that the upper portion of the cut tubing may be removed in total from the well.

After the tool 10 is positioned, the ignitor 20 is checked by a test circuit (not shown) in section 14 and thereon energized to ignite the propellant 18.

As the propellant 18 begins to burn, a gas pressure is developed which may be in the order of several thousand psi "real" pressure within tool 10, and which will be a lesser differential pressure between the inside and outside of tool 10, depending on the hydrostatic pressure of the well fluids at the depth where tool 10 is positioned.

The increasing pressure extends the slips 26 into contact with the interior of the tubing and anchors the tool 10 in fixed position so that it may not move either upwardly or downwardly in the tubing during the cutting operation.

As the gas pressure developes to a magnitude sufficient to rupture the upper rupture diaphragm 32*a* of the chamber 28*a*, the diaphragm 32*a* shown in FIG. 1 ruptures abruptly and this pressure is thereon transmitted through the reactant 30*a* to the rupture diaphragm 32*a*, which also ruptures.

The propellant in power section 16 is continuing to burn and the pressure developed within the chamber remains high. The reactant 30*a*, responsive to the pressure from the propellant 18, is moved by the gas pressure force applied, such force being generally a function of the gas pressure and the cross sectional area of the interior of the chamber 28*a*.

The reactant 30*a* thereon moves downwardly through the chamber 36*a* at an increasing velocity determined by the force of the gas pressure and the mass of the reactant.

After moving through the distance Sa, the reactant 30*a* encounters the upper diaphragm 32*b* of the chamber 28*b* and thereon ruptures diaphragm 32*b*, transmitting the force to the reactant 30*b* and to the diaphragm 34*b*. Diaphragm 32*b* and 34*b* thereon rupture, and the reactants 30*a* and 30*b* encounters the upper diaphragm 32*c* and the force is thereon transmitted through diaphrams 32*c*, reactant 30*c*, and diaphram 34*c*, rupturing these diaphrams and moving the then combined aggregate masses of reactants 30*a*, 30*b*, and 30*c* down through chamber 36*c* through a distance Sc into and through the face 42 into the treating material 40.

Within the treating chamber 38, the reactant coming into contact with the treating material 40 immediately reacts with the treating material, causing a very high rate of temperature increase which may be herein termed incendiary for the purpose of describing the state the reactant is in when it leaves the chamber 38. The reactant thereon continues down through the passage 44 and imposes the force from the reactant against the jet release plug 46 until the shear washer 50 has sheared, permitting the plug 48 to move down and expose the cutting jets 48.

As previously disclosed with reference to FIG. 2, each of the diaphragm 32*a*, 32*b*, 32*c*, 34*a*, 34*b*, and 34*c* may be a cbmbination including two rupture membranes separated by an air space. As assembled into tool 10, these diaphragm combinations will be respectively and sequentially ruptured in the operation of the tool as described above.

These double membrane rupture diaphragm as described provide two improvements:

One, the flow of the reactant within the tool is cushioned or muffled to some extent by rupture of first a single diaphram into the air space and consequent passage of the reactant 30*b* through the first diaphram to rupture and flow through the second diaphragm. The kinetics are such that total flow of the reactant 30 is with less turbulance.

The second advantage of this feature is that of safety. With two rupture membranes in each rupture diaphragm, if the tool is "spudded" within the well to pass obstructions or the like, the impact which might rupture a single diaphragm. In the event of FIG. 2, a second rupture membrane serves as the safety feature.

If a single diaphragm such as diaphragm 34*c* were to rupture and let the chemical reagent into the catalytic chamber, the tool would begin to cut anywhere in the well bore, an undesirable situation.

The very high pressure of the propellant gases forces the aggregate reactant mass 30, aided by the kinetic energy of the moving aggregate mass of reactant, out through the cutting jets 48 at very high velocity against the interior surface of the tubing to be cut.

The cutting action, or reaction, of the reactant with the metal of the tubing begins instantaneously upon contact of the reactant and the metal. The very high velocity of the reactant, in flowing connection with the metal, causes a cleansing and flushing action at the reaction interface of the reactant and the metal and carries away the reaction products as fast as such reaction products are formed.

Ideally, the reaction products of the reactant and the metal should be washed or flushed away as rapidly, or more rapidly, than the reaction is occuring. Such flushing is desirable even though all the reactant is not utilized in the reaction.

After the reactant is completely ejected from the tool 10, it is followed by the gases developed by the propellant 18 until such time as the gas pressure within the tool 10 and the hydrostatic fluid pressure outside the tool 10 become equal.

When the pressure inside and outside the tool 10 becomes equal, or very nearly equal, the slips 26 are resiliently retracted by spring means (not shown) and the tool 10 is free for withdrawal from the well.

The tool 10 is thereon pulled out of the well by means of a cable 12 and subsequently the tubing which has been cut is also removed from the well in a joint by joint fashion as commonly known in the art.

It is to be noted that other embodiments may differ somewhat from those shown herein, yet utilize the concept of the invention as specified in the appended claims.

We claim:

1. A tool for cutting metal by expelling a stream of liquid chemical cutting reactant into forceful flowing contact with a designated area of said metal comprising:

a first mass of said reactant housed within said tool and sealed therein by a first and second rupture diaphragm, each of said rupture diaphragms including a first and second rupture membrane and an air space disposed between said rupture membranes;

means for applying a force to said first rupture diaphragm sufficient to breach said first rupture diaphragm and sufficient to cause said first mass to breach said second rupture diaphragm;

a heating medium adapted to pass said first mass therethrough for heating said first mass to a substantially elevated temperature; and means for directing the flow of said first mass as heated through at least one orifice into flowing contact with said metal.

2. The tool according to claim 1 further including a second mass of said reactant housed within said tool and spaced a linear distance from said first mass to be encountered by said first mass and form a portion of an aggregate mass therewith.

3. The tool according to claim 1 wherein said heating medium is comprised of a permeable material having exposed surfaces chemically reactive with said reactant.

* * * * *